US010801137B2

(12) United States Patent
Chamberlin et al.

(10) Patent No.: US 10,801,137 B2
(45) Date of Patent: Oct. 13, 2020

(54) GLASS CLOTH INCLUDING ATTACHED FIBERS

(71) Applicant: International Business Machines Corporation, Armonk, NY (US)

(72) Inventors: Bruce J. Chamberlin, Vestal, NY (US); Scott B. King, Rochester, MN (US); Joseph Kuczynski, North Port, FL (US); David J. Russell, Owego, NY (US)

(73) Assignee: International Business Machines Corporation, Armonk, NY (US)

( * ) Notice: Subject to any disclaimer, the term of this patent is extended or adjusted under 35 U.S.C. 154(b) by 683 days.

(21) Appl. No.: 15/216,195

(22) Filed: Jul. 21, 2016

(65) Prior Publication Data

US 2018/0023225 A1 Jan. 25, 2018

(51) Int. Cl.
*D04H 3/004* (2012.01)
*D03D 15/00* (2006.01)

(52) U.S. Cl.
CPC ..... *D03D 15/0011* (2013.01)

(58) Field of Classification Search
None
See application file for complete search history.

(56) References Cited

U.S. PATENT DOCUMENTS 3,130,755 A * 4/1964 Russell ..... D03D 7/00 139/18
3,275,489 A * 9/1966 Talv ..... D04H 3/04 156/181
3,690,990 A * 9/1972 Izumi ..... B65H 51/16 156/441
4,735,672 A * 4/1988 Blad ..... B29C 70/382 156/361
5,590,054 A * 12/1996 McIntosh ..... A47J 41/02 215/12.1
7,049,253 B1 * 5/2006 Kimura ..... D03D 15/0011 139/420 R
7,151,228 B2 12/2006 Takase et al.
7,648,758 B2 1/2010 Morin
9,060,455 B2 6/2015 Kondo
2006/0127635 A1 * 6/2006 Colson ..... B65H 81/00 428/105

(Continued)

FOREIGN PATENT DOCUMENTS

CN 100469215 C 3/2009
CN 203418858 U 2/2014
JP 55-053554 A * 4/1980

(Continued)

OTHER PUBLICATIONS

Macine Translation of Korean Patent 10-2012-0130534, Date Unknown.*

(Continued)

*Primary Examiner* — Jeffry H Aftergut
(74) *Attorney, Agent, or Firm* — Patterson + Sheridan, LLP

(57) ABSTRACT

A glass fiber cloth includes a first warp glass fiber, a second warp glass fiber, and a weft glass fiber. The second warp glass fiber is adjacent to the first warp glass fiber. The weft glass fiber is overlaid over the first warp glass fiber and the second warp glass fiber. The weft glass fiber is attached to the first warp glass fiber.

12 Claims, 3 Drawing Sheets

(56) References Cited

U.S. PATENT DOCUMENTS

2008/0188153 A1 8/2008 Morin

FOREIGN PATENT DOCUMENTS

| | | | | |
|---|---|---|---|---|
| JP | 11-189963 | A | * | 7/1999 |
| JP | 2004140118 | A | | 5/2004 |
| JP | 2007019217 | A | | 1/2007 |
| JP | 4622939 | B2 | | 2/2011 |
| JP | 20154088537 | A | | 5/2015 |
| KR | 1020080098692 | A | | 11/2008 |
| KR | 10-2012-0130534 | A | * | 12/2012 |
| WO | WO-2016/001040 | | * | 1/2016 |

OTHER PUBLICATIONS

Dudek, et al., "Advanced Glass Reinforcement Technology for Improved Signal Integrity", Presented at the HyperTransport Technology Developers Conference, Oct. 2007.

Horn, et al., "Investigations on Melting and Welding of Glass by Ultra-Short Laser Radiation", Journal of Laser Micro/Nanoengineering, vol. 3, No. 2, 2008, 5 pp.

NetComposites Now "Woven Fabrics—Reinforcements—Guide to Composite Materials", 2016, http://www.netcomposites.com/guide/woven-fabrics/40, 8 pp.

* cited by examiner

GLASS CLOTH INCLUDING ATTACHED FIBERS

BACKGROUND

Woven glass cloth is used in a variety of applications. For example, woven glass cloth may be used in production of circuit boards. A woven glass cloth includes "warp" glass fiber yarns arranged in a first direction (e.g., vertical) and "weft" glass fiber yarns arranged in a second (e.g., horizontal) direction. A woven glass cloth's mechanical properties can be influenced by the pattern of weave used to create the glass cloth. In a plain weave pattern, each warp glass fiber yarn passes alternately over and under each weft glass fiber yarn.

SUMMARY

A particular implementation of the present disclosure includes a glass fiber cloth. The glass fiber cloth includes a first warp glass fiber, a second warp glass fiber, and a weft glass fiber. The second warp glass fiber is adjacent to the first warp glass fiber. The weft glass fiber is overlaid over the first warp glass fiber and the second warp glass fiber. The weft glass fiber is attached to the first warp glass fiber.

In another particular implementation, a method of forming a glass cloth includes passing a weft glass fiber over a first warp glass fiber and a second warp glass fiber. The first warp glass fiber is adjacent to the second warp glass fiber. The method further includes attaching the weft glass fiber to the first warp glass fiber.

In another particular implementation, a computer-readable storage medium stores instructions that are executable by a processor to perform operations. The operations include initiating passing a weft glass fiber over a first warp glass fiber and a second warp glass fiber. The first warp glass fiber is adjacent to the second warp glass fiber. The operations further include initiating attaching the weft glass fiber to the first warp glass fiber.

DETAILED DESCRIPTION

The regions of a woven glass cloth where multiple fibers are present (e.g., with one fiber passing over the other fiber) is called a "knuckle." Woven fabrics may further include "weaving windows" (e.g., gaps) between fibers through which fibers are interwoven. Thus, a woven glass cloth may include areas that have one glass fiber or two glass fibers and may further include gaps where no fibers are present. For example, glass cloth may be used to reinforce a non-conductive substrate to which copper traces are bonded in printed circuit boards. The variation in number of glass fibers present across the surface may cause the glass cloth to have one or more parasitic elements (e.g., varying dielectric constants across the surface). Accordingly, signals routed along a conductive trace bonded to the glass cloth may degrade. Further, timing of signals routed along traces that traverse different portions of the glass cloth may be skewed differently based on the varied topography of the glass cloth (e.g., because the dielectric constants of different portions of the glass cloth may be different). The varied timing may negatively impact performance of electronic devices.

The present disclosure provides a glass cloth in which warp and weft glass fibers may be attached to each other. Attaching warp and weft glass fibers may enable a weft glass fiber to be passed across the same side of (e.g., over/under) a group of warp glass fibers. The glass cloth may have increased mechanical strength properties due to the warp and weft glass fibers being attached. Since the weft glass fiber is passed to the same side of the warp glass fibers, the warp glass fibers may be placed closer together, reducing the weaving window. Accordingly, there may be fewer gaps and there may be less area of the glass cloth covered by a single fiber. Further, the resulting glass cloth may have a substantially uniform thickness (e.g., 2 fibers thick). Therefore, the glass cloth may have a more uniform dielectric constant than glass cloths without attached warp and weft glass fibers (e.g., because such glass cloths rely on weaving for mechanical strength). Further, since the topography of the glass cloth may be more uniform (e.g., the glass cloth may be flatter and/or smoother) than glass cloths without attached warp and weft glass fibers, signals routed along traces bonded to the glass cloth (e.g., via conductive traces) may experience less timing skew (e.g., because the dielectric constant across the glass cloth may be more uniform) and may thus be preferred for electrical applications, such as circuit boards. To illustrate, copper traces may be bonded to a non-conductive substrate that is reinforced by a glass cloth. In particular applications, 40 or more glass cloth layers may be incorporated into a circuit board. It should be noted that while particular advantages are described herein, such advantages are not required by all implementations.

Figure 1:
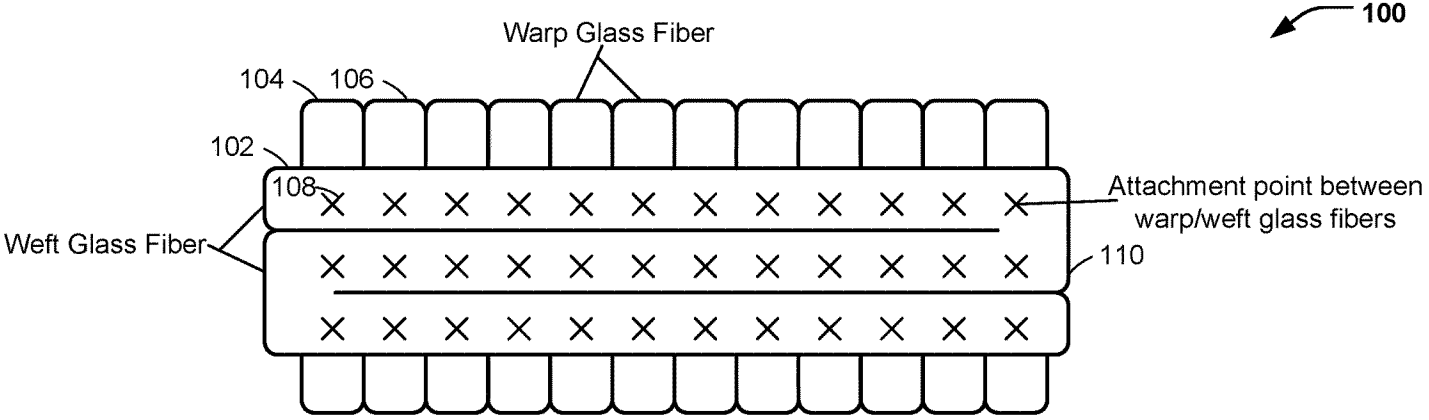
FIG. 1 is a diagram illustrating an example of a glass fiber cloth.

Referring to FIG. 1, a glass cloth 100 is illustrated. The glass cloth 100 includes a plurality of warp glass fibers and a plurality of weft glass fibers. The plurality of warp glass fibers includes a first warp glass fiber 104 and a second warp glass fiber 106. The plurality of weft glass fibers includes a first weft glass fiber 102 and a second weft glass fiber 110. In the illustrated example, the weft glass fibers 102, 110 correspond to different horizontal fibers of the glass cloth 100 formed from a single glass fiber yarn (e.g., a single strand of glass fiber). In other implementations, weft glass fibers 102, 110 may be formed from distinct glass fiber yarns.

The first weft glass fiber 102 may be attached to one or more of the plurality of warp glass fibers. In particular implementations, the first weft glass fiber 102 may be welded (e.g., laser welded) or adhesively attached (e.g., with a cyanoacrylate adhesive or an epoxy-based adhesive) to one or more of the plurality of warp glass fibers. In the illustrated example, the first weft glass fiber 102 is attached to the first warp glass fiber 104 at a connection point 108.

Since the first weft glass fiber 102 is attached to the first warp glass fiber 104, the first weft glass fiber 102 may be placed on a common side (e.g., the first weft glass fiber 102 may be passed over) a group of adjacent (e.g., glass fibers that are next to each other) warp glass fibers of the plurality of warp glass fibers. For example, the first weft glass fiber 102 passes over both the first warp glass fiber 104 and the second warp glass fiber 106. In some implementations, warp glass fibers that are adjacent to each other may be in contact with each other. For example, the first warp glass fiber 104 may be in contact with the second warp glass fiber 106. In other examples, warp glass fibers may be separated.

In the example illustrated in FIG. 1, the first weft glass fiber 102 passes over each warp glass fiber of the plurality of warp glass fibers included in the glass cloth 100. However, in other examples, weft glass fibers may alternate between passing over and under warp glass fibers at different intervals, as described further below. In the illustrated example, the first weft glass fiber 102 is attached to each of the plurality of warp glass fibers included in the glass cloth 100. In different implementations, weft glass fibers may be attached to some but not all warp glass fibers. For example, a particular weft glass fiber may be attached to every tenth warp glass fiber.

In some implementations, adjacent weft glass fibers may pass to the same side of warp glass fibers. For example, the second weft glass fiber 110 passes over the first warp glass fiber 104 and the second warp glass fiber 106. In other implementations, adjacent weft glass fibers may traverse a common warp glass fiber differently (e.g., one weft glass fiber may pass over the common warp glass fiber while the other passes under the common warp glass fiber). In the illustrated example, each weft glass fiber of the glass cloth 100 passes over each warp glass fiber of the glass cloth 100. Adjacent weft glass fibers may be in contact with each other. For example, the first weft glass fiber 102 may be in contact with the second weft glass fiber 110. In other examples, weft glass fibers may be separated.

Since the first weft glass fiber 102 passes to the same side of (e.g., over) more than one warp glass fiber (e.g., the warp glass fibers 104, 106), the warp glass fibers may be located closer together (e.g., because a weaving window (e.g., a gap between glass fibers) to pass the weft glass fibers between the warp glass fibers is not necessary) than in glass cloths without attached warp and weft glass fibers. Further, the glass cloth 100 may include relatively fewer knuckles (e.g., regions where weft glass fibers transition from passing to one side to passing to another side of warp glass fibers) than glass cloths that rely on weaving. Accordingly, the surface of the glass cloth 100 may be more uniform than other glass cloths. In particular examples, the glass cloth 100 may have no window and may be a homogenous cloth including two perpendicular layers throughout the cloth (e.g., glass cloths that rely on weaving). Therefore, the glass cloth 100 may have a more uniform dielectric constant than glass cloths that rely on weaving, which may result in improved quality of electrical signals transmitted along conductive elements in contact with (e.g., bonded to) the glass cloth 100. Further, travel time of the electrical signals may have less skew relative to each other because the dielectric constant across the surface of the glass cloth 100 may vary less than in a glass cloth that relies on weaving.

Figure 2:
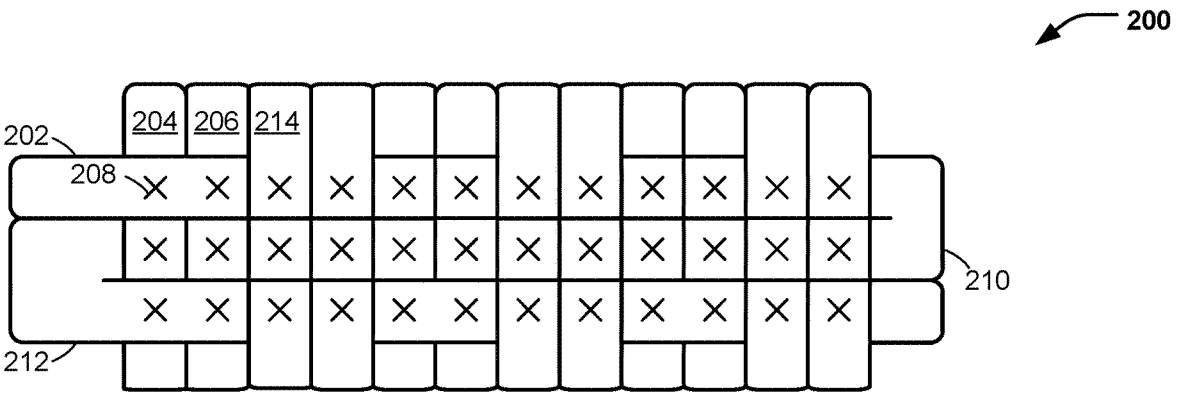
FIG. 2 is a diagram illustrating another example of a glass fiber cloth.

Referring to FIG. 2, another example of a glass cloth 200 is shown. The glass cloth 200 includes a plurality of warp glass fibers and a plurality of weft glass fibers. The plurality of warp glass fibers includes a first warp glass fiber 204, a second warp glass fiber 206, and a third warp glass fiber 214. The plurality of weft glass fibers includes a first weft glass fiber 202, a second weft glass fiber 210, and a third weft glass fiber 212. In the illustrated example, the weft glass fibers 202, 210, 212 correspond to different horizontal fibers of the glass cloth 200 formed from a single glass fiber yarn. In other implementations, the weft glass fibers 202, 210, 212 may be formed from distinct glass fiber yarns.

The first weft glass fiber 202 may be attached to one or more of the plurality of warp glass fibers. In particular implementations, the first weft glass fiber 202 may be welded (e.g., laser welded) or adhesively attached to one or more of the plurality of warp glass fibers. In the illustrated example, the first weft glass fiber 202 is attached to the first warp glass fiber 204 at a connection point 208.

Since the first weft glass fiber 202 is attached to the first warp glass fiber 204, the glass cloth 200 may have mechanical properties (e.g., strength) that are not dependent on interweaving the first weft glass fiber 202 with the warp glass fibers. Accordingly, the first weft glass fiber 202 may be placed on a common side of (e.g., the first weft glass fiber 202 may be passed over) a group of adjacent (e.g., glass fibers that are next to each other) warp glass fibers of the plurality of warp glass fibers. For example, the first weft glass fiber 202 passes over both the first warp glass fiber 204 and the second warp glass fiber 206. In some implementations, warp glass fibers that are adjacent to each other may be in contact with each other. For example, the first warp glass fiber 204 may be in contact with the second warp glass fiber 206. In other examples, warp glass fibers may be separated.

In the example illustrated in FIG. 1, the first weft glass fiber 102 passes over each warp glass fiber of the plurality of warp glass fibers included in the glass cloth 100. However, in the example illustrated in FIG. 2, the first weft glass fiber 202 passes under some warp glass fibers of the plurality of warp glass fibers included in the glass cloth 200. To illustrate, the first weft glass fiber 202 passes under the third warp glass fiber 214. The third warp glass fiber 214 is adjacent to the second warp glass fiber 206. In different implementations, a particular weft glass fiber may pass over or under warp glass fibers in different patterns than those shown in FIGS. 1 and 2. For example, a particular weft glass fiber may pass to a common side of (e.g., over or under) 3 adjacent warp glass fibers before passing under a warp glass fiber. Further, while FIG. 2 illustrates weft glass fibers passing over and under equal numbers of warp glass fibers, different patterns are possible in conjunction with the present disclosure. For example, a particular weft glass fiber may pass over 2 adjacent warp glass fibers and then alternate between passing over and under every other warp glass fiber. Any arrangement of the warp and weft glass fibers is possible. In the illustrated example, each weft glass fiber is attached to each warp glass fiber. In different implementations, weft glass fibers may be attached to less than all of the warp glass fibers. For example, a particular weft glass fiber may be attached (i.e., an attachment point may be present) to every tenth warp glass fiber.

In some implementations, adjacent weft glass fibers may pass to different sides of warp glass fibers. For example, the second weft glass fiber 210 passes under the first warp glass fiber 204 and the second warp glass fiber 206. In other examples, adjacent weft glass fibers may traverse a common warp glass fiber differently. To illustrate, the third weft glass fiber 212 passes over the first warp glass fiber 204 and the second warp glass fiber 206. The second weft glass fiber 210 may be adjacent to the first weft glass fiber 202 and to the third weft glass fiber 212. Adjacent weft glass fibers may be in contact with each other. For example, the second weft glass fiber 210 may be in contact with the first weft glass fiber 202 and the third weft glass fiber 212. In other examples, adjacent weft glass fibers may not be in contact with each other.

Since the first weft glass fiber 202 passes to the same side of (e.g., over) more than one warp glass fiber (e.g., the warp glass fibers 204,206), the warp glass fibers may be located closer together (e.g., because a weaving window (e.g., a gap between glass fibers) to interweave the warp glass fibers and the weft glass fibers is not necessary). Further, the glass cloth 200 may include relatively fewer knuckles (e.g., regions where weft glass fibers transition from passing to one side to passing to another side of warp glass fibers) than glass cloths that rely solely on interweaving. Accordingly, the surface of the glass cloth 200 may be more uniform than other glass cloths (e.g., glass cloths that rely on interweaving for mechanical properties). Therefore, the glass cloth 200 may have a more uniform dielectric constant than glass cloths that rely solely on interweaving, which may result in improved quality of electrical signals transmitted across the surface of the glass cloth 200. Further, travel time of the electrical signals may be skewed less by changes in dielectric constants across the surface of the glass cloth 200 as compared to glass cloths that rely solely on interweaving.

Figure 3:
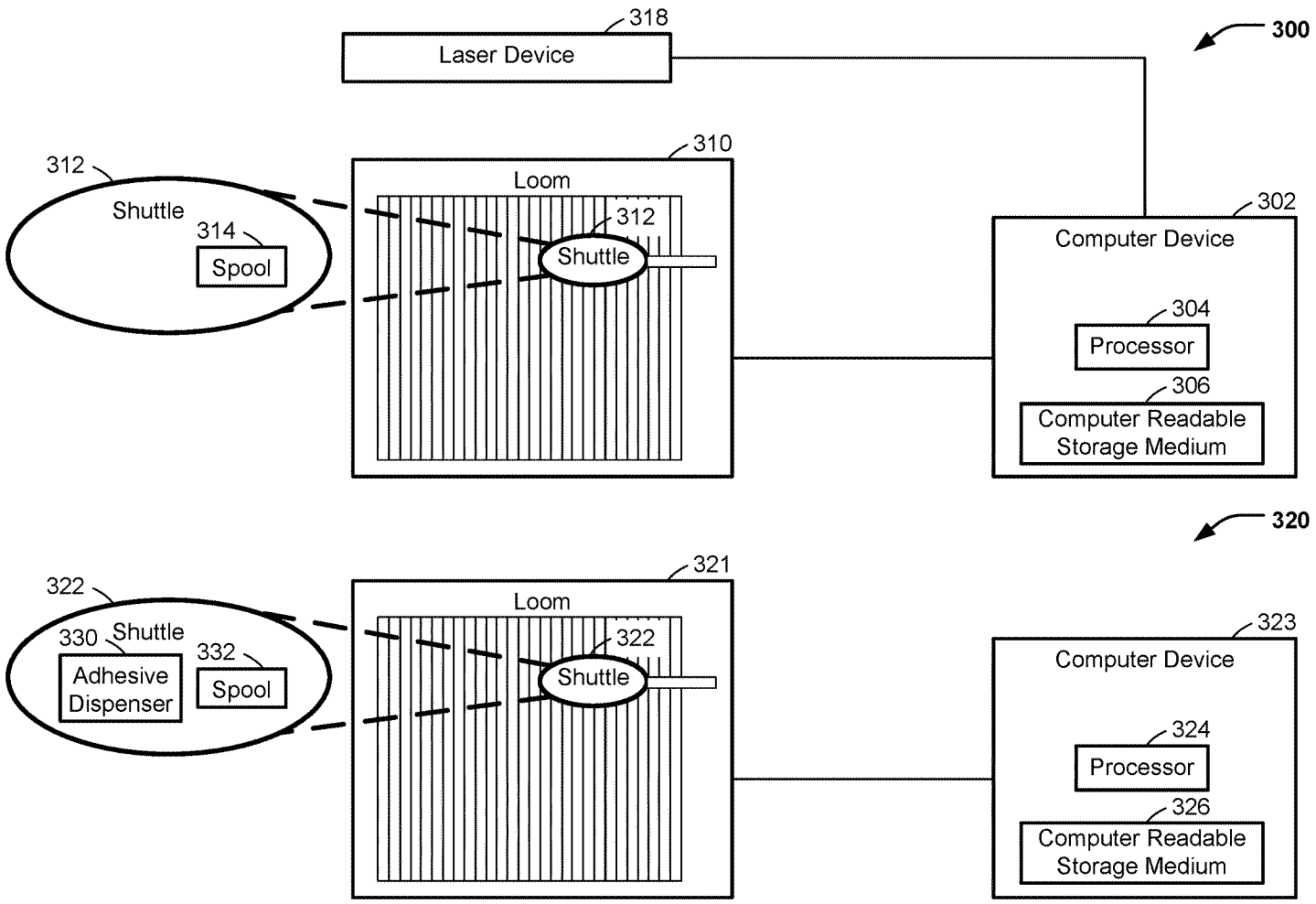
FIG. 3 is a diagram illustrating systems for forming a glass fiber cloth.

Referring to FIG. 3, a first system 300 and a second system 320 for creating glass cloth are shown. The systems 300 and 320 are examples of systems that may be used to create the glass cloth 100 or the glass cloth 200. The first system 300 is an example of a system that creates glass cloth by welding glass fibers together with a laser. The second system 320 is an example of a system that creates glass cloth by adhesively attaching glass fibers.

The first system 300 includes a computer device 302, a loom 310, and a laser device 318. In particular implementations, one or more of the computer device 302 and the laser device 318 may be a component of the loom 310. In other examples, the laser device 318 may be a separate device. The loom 310 may include a shuttle 312. The shuttle 312 may include a spool 314. Warp glass fibers may be arranged within the loom 310, as shown, and the spool 314 may include a glass fiber yarn. In particular examples, the warp glass fibers may be laid out within the loom 310 from one or more spools (e.g., in response to signals from the computer device 302). For example, one or more control signals may cause the loom 310 to pull the warp glass fibers across the loom (e.g., via a mechanical arm). In some examples, one or more of the warp glass fibers may be coupled to actuator(s) (e.g., by the mechanical arm).

The computer device 302 may include a computer readable storage medium 306 and a processor 304. The computer readable storage medium 306 may store instructions that, when executed by the processor 304, cause the processor 304 to perform operations associated with forming a glass cloth, such as the glass cloth 100.

For example, the processor 304 may generate one or more signals (e.g., signals transmitted to the loom 310 via a communications bus) causing the loom 310 to pass the shuttle 312 across the warp glass fibers arranged in the loom 310. As the shuttle 312 is passed across the warp glass fibers, the spool 314 may unwind to lay weft glass fibers either under or over the warp glass fibers. The processor 304 may control whether the weft glass fibers pass over or under the warp glass fibers by signaling the loom 310 to activate one or more actuators to change positions (e.g., raise or lower) of the warp glass fibers. The shuttle 312 may pass under or over the warp glass fibers according to the positions of the warp glass fibers.

The processor 304 may further cause the laser device 318 to weld weft glass fibers to warp glass fibers at a particular position interval (e.g., every Nth warp glass fiber, where N is an integer greater than or equal to 1). For example, referring to the glass cloth 100 of FIG. 1, the processor 304 may cause (e.g., send an activation signal to) the laser device 318 to weld the first weft glass fiber 102 to the first warp glass fiber 104 at the connection point 108. As a further example, referring to the glass cloth 200 of FIG. 2, the processor 304 may cause the laser device 318 to weld the first weft glass fiber 202 to the first warp glass fiber 204 at the connection point 208. In particular examples, the processor 304 may cause (e.g., send activation signals that cause) the laser device 318 to weld each weft glass fiber to each warp glass fiber or may cause the laser device 318 to weld each weft glass fiber to warp glass fibers at an interval greater than one. To illustrate, the processor 304 may cause the laser device 318 to weld a particular weft glass fiber to every tenth warp glass fiber. In other examples, the processor 304 may cause the laser device 318 to weld weft glass fibers to warp glass fibers according to some other pattern. Thus, the first system 300 may be used to form glass cloths with attached fibers, such as the glass cloth 100.

The second system 320 includes a computer device 323 and a loom 321. In particular implementations, the computer device 323 may be integrated into the loom 321. The loom 321 may include a shuttle 322. The shuttle 322 may include a spool 332 and an adhesive dispenser 330. Warp glass fibers may be arranged within the loom 321, as shown, and the spool 332 may include a glass fiber yarn. In particular examples, the warp glass fibers may be laid out within the loom 321 from one or more spools (e.g., in response to signals from the computer device 323). For example, one or more control signals generated by the computer device 323 may cause the loom 321 to pull the warp glass fibers across the loom (e.g., via a mechanical arm). In some examples, one or more of the warp glass fibers may be coupled to actuator(s) (e.g., by the mechanical arm).

The computer device 323 may include a computer readable storage medium 326 and a processor 324. The computer readable storage medium 326 may store instructions that, when executed by the processor 324, cause the processor 324 to perform operations associated with forming a glass cloth, such as the glass cloth 100.

For example, the processor 324 may generate one or more signals (e.g., signals transmitted to the loom 321 via a communication bus) causing the loom 321 to pass the shuttle 322 across the warp glass fibers arranged in the loom 321. As the shuttle 322 is passed across the warp glass fibers, the spool 332 may unwind to lay weft glass fibers across either under or over the warp glass fibers. The processor 324 may control whether the weft glass fibers pass over or under the warp glass fibers by signaling the loom 321 to activate one or more actuators to change positions (e.g., raise or lower) of the warp glass fibers. The shuttle 322 may pass under or over the warp glass fibers according to the positions of the warp glass fibers.

Further the computer device 323 may send one or more signals to the loom 321 causing adhesive dispenser 330 of the shuttle 322 to distribute adhesive onto the glass fiber yarn of the spool 332 as the glass fiber yarn is dispensed from the shuttle 322. In another example, the adhesive dispenser may apply the adhesive to the warp glass fibers as the shuttle 322 passes the warp glass fibers. In particular examples, the processor 324 may cause (e.g., send activation signals to) the adhesive dispenser to adhesively attach each weft glass fiber to each warp glass fiber or may cause the adhesive dispenser 330 to adhesively attach each weft glass fiber to warp glass fibers at an interval greater than one. To illustrate, the processor 324 may cause (e.g., send activation signals to) the adhesive dispenser 330 to adhesively attach a particular weft glass fiber to every tenth warp glass fiber. In other examples, the processor 324 may cause the adhesive dispenser 330 to adhesively attach weft glass fibers to warp glass fibers according to some other pattern. Thus, the second system 320 may be used to form glass cloths with attached fibers, such as the glass cloth 100.

Figure 4:
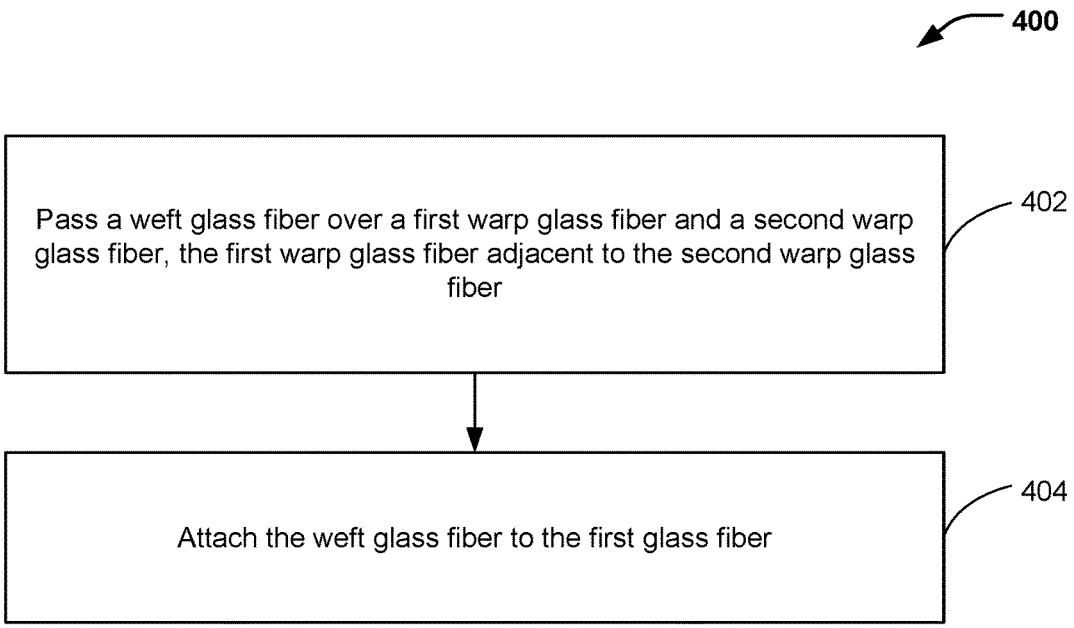
FIG. 4 is a flowchart illustrating a method of forming a glass fiber cloth.

Referring to FIG. 4, a flowchart depicting a method 400 of forming a glass cloth (e.g., the glass cloth 100 or the glass cloth 200) is shown. For example, the method 400 may be implemented by the first system 300 or the second system 320. To illustrate, the computer readable storage medium 306 or the computer readable storage medium 326 may store instructions that cause the method 400 to be performed by the first system 300 or the second system 320.

The method 400 includes passing, by a loom, a weft glass fiber over a first warp glass fiber and a second warp glass fiber, the first warp glass fiber adjacent to the second warp glass fiber, at 402. For example, with reference to the first glass cloth 100, the processor 304 may send one or more signals to the loom 310 causing the loom 310 to pass the shuttle 312 over the first warp glass fiber 104 and the second warp glass fiber 106. The spool 314 may release the first weft glass fiber 102 over the warp glass fibers 104, 106. The warp glass fibers 104, 106 are adjacent to each other. Similarly, with reference to the second glass cloth 200, the processor 304 may send one or more signals to the loom 310 causing the loom 310 to pass the shuttle 312 over the first warp glass fiber 204 and the second warp glass fiber 206. The spool 314 may release the first weft glass fiber 202 over the warp glass fibers 204, 206. The warp glass fibers 204, 206 are adjacent to each other.

In yet another example with reference to the first glass cloth 100, the processor 324 may send one or more signals to the loom 321 causing the loom 321 to pass the shuttle 322 over the first warp glass fiber 104 and the second warp glass fiber 106. The spool 332 may release the first weft glass fiber 102 over the warp glass fibers 104, 106. The warp glass fibers 104, 106 are adjacent to each other. Similarly, with reference to the second glass cloth 200, the processor 324 may send one or more signals to the loom 321 causing the loom to pass the shuttle 322 over the first warp glass fiber 204 and the second warp glass fiber 206. The spool 332 may release the first weft glass fiber 202 over the warp glass fibers 204, 206. The warp glass fibers 204, 206 are adjacent to each other.

The method 400 further includes attaching, by the loom, the weft glass fiber to the first warp glass fiber. For example, with reference to the first glass cloth 100, the processor 304 may send one or more signals to the laser device 318 causing the laser device 318 to apply a laser pulse to the first weft glass fiber 102 or to the first warp glass fiber 104 to weld the first weft glass fiber 102 to the first warp glass fiber 104 at the connection point 108. The laser device 318 may be integrated into the loom 310. As another example, with reference to the second glass cloth 200, the processor 304 may send one or more signals to the laser device 318 causing the laser device 318 to apply a laser pulse to the first weft glass fiber 202 or to the first warp glass fiber 204 to weld the first weft glass fiber 202 to the first warp glass fiber 204 at the connection point 208. The laser device 318 may be integrated into the loom 310.

In yet another example with reference to the first glass cloth 100, the processor 324 may send one or more signals to the loom 321 causing the adhesive dispenser 330 to dispense adhesive onto the first weft glass fiber 102 or onto the first warp glass fiber 104 to adhesively attach the first weft glass fiber 102 to the first warp glass fiber 104 at the connection point 108. Similarly, with reference to the second glass cloth 200, the processor 324 may send one or more signals to the loom 321 causing the adhesive dispenser 330 to dispense adhesive onto the first weft glass fiber 202 or onto the first warp glass fiber 204 to adhesively attach the first weft glass fiber 202 to the first warp glass fiber 204 at the connection point 208.

In a particular implementation, the method 400 further includes attaching the weft glass fiber to the second warp glass fiber. In a particular implementation, the method 400 further includes passing the weft glass fiber under a third warp glass fiber and attaching the weft glass fiber to the third warp glass fiber.

In a particular implementation, the method 400 further includes passing a second weft glass fiber over the first warp glass fiber and the second warp glass fiber. The second weft glass fiber may be adjacent to the weft glass fiber. The method 400 may further include attaching the second weft glass fiber to the first warp glass fiber.

In a particular implementation, the method 400 further includes attaching the weft glass fiber to every Nth warp glass fiber attached to the loom, where N is an integer greater than or equal to one (e.g., N=10). In other implementations, the weft glass fiber may be attached to warp glass fibers attached to the loom according to a different sequence or pattern. For example, the warp weft glass fiber may be attached to the warp glass fibers according to the Fibonacci sequence or according to some other sequence or pattern. In a particular implementation, the method 400 further includes attaching the weft glass fiber to every warp glass fiber attached to the loom. In a particular implementation, the method 400 further includes winding the glass cloth onto a spool of cloth. The spool of cloth may be shipped to a circuit board fabricator.

The present disclosure may relate to a system, a method, and/or a computer program product at any possible technical detail level of integration. The computer program product may include a computer readable storage medium (or media) having computer readable program instructions thereon for causing a processor to carry out implementations of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform implementations of the present disclosure.

Implementations of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The previous description of the disclosed implementations is provided to enable a person skilled in the art to make or use the disclosed implementations. Various modifications to these implementations will be readily apparent to those skilled in the art, and the generic principles defined herein may be applied to other implementations without departing from the scope of the disclosure. Thus, the present disclosure is not intended to be limited to the implementations shown herein but is to be accorded the widest scope possible consistent with the principles and features as defined by the following claims.

What is claimed is:

1. A method of forming a glass cloth, comprising:

passing a first portion of a weft glass fiber in a first direction over a first warp glass fiber and a second warp glass fiber using a shuttle, the shuttle comprising an adhesive dispenser, the first warp glass fiber adjacent to the second warp glass fiber;

attaching the weft glass fiber to the first warp glass fiber, wherein attaching the weft glass fiber to the first warp glass fiber includes dispensing an adhesive from the adhesive dispenser on the first warp glass fiber at a connection point between the weft glass fiber and the first warp glass fiber, wherein the adhesive is dispensed as the shuttle passes the first portion of the weft glass fiber over the first warp glass fiber, wherein the adhesive comprises a cyanoacrylate adhesive; and passing a second portion of the weft glass fiber in a second direction over the second warp glass fiber and the first warp glass fiber, wherein the second portion is parallel to the first portion and the second direction opposes the first direction, the glass cloth having no spacing between the warp glass fiber and the weft glass fiber.

2. The method of claim 1, further comprising attaching the weft glass fiber to the second warp glass fiber.

3. The method of claim 1, further comprising attaching the weft glass fiber to every tenth warp glass fiber.

4. The method of claim 1, further comprising attaching the weft glass fiber to every warp glass fiber.

5. The method of claim 1, further comprising attaching the weft glass fiber to every two adjacent warp glass fibers.

6. A method of forming a glass cloth, comprising:

passing a first portion of a weft glass fiber in a first direction over a first warp glass fiber and a second warp glass fiber using a shuttle, the shuttle comprising an adhesive dispenser, the first warp glass fiber adjacent to the second warp glass fiber;

attaching the weft glass fiber to the first warp glass fiber, wherein attaching the weft glass fiber to the first warp glass fiber includes intermittently dispensing an adhesive from the adhesive dispenser on the first warp glass fiber at a connection point between the weft glass fiber and the first warp glass fiber, wherein the adhesive is dispensed as the shuttle passes the first portion of the weft glass fiber over the first warp glass fiber, wherein the weft glass fiber is disposed entirely on a first side of the glass cloth and the first and second warp glass fibers are disposed entirely on a second side of the glass cloth; and passing a second portion of the weft glass fiber in a second direction over the second warp glass fiber and the first warp glass fiber, wherein the second portion is parallel to the first portion and the second direction opposes the first direction.

7. The method of claim 6, wherein the glass cloth has no spacing between the warp glass fibers and the weft glass fiber.

8. A method of forming a glass cloth, comprising:

passing a first portion of a weft glass fiber in a first direction over a first warp glass fiber and a second warp glass fiber using a shuttle, the shuttle comprising an adhesive dispenser, the first warp glass fiber adjacent to the second warp glass fiber;

attaching the weft glass fiber to the first warp glass fiber, wherein attaching the weft glass fiber to the first warp glass fiber includes dispensing an adhesive from the adhesive dispenser on the first warp glass fiber at a connection point between the weft glass fiber and the first warp glass fiber, wherein the adhesive is dispensed as the shuttle passes the first portion of the weft glass fiber over the first warp glass fiber, the nonwoven glass cloth having no spacing between the warp glass fibers and the weft glass fiber; and passing a second portion of the weft glass fiber in a second direction over the second warp glass fiber and the first warp glass fiber, wherein the second portion is parallel to the first portion and the second direction opposes the first direction.

9. The method of claim 8, further comprising attaching the weft glass fiber to the second warp glass fiber.

10. The method of claim 8, further comprising attaching the weft glass fiber to every tenth warp glass fiber.

11. The method of claim 8, further comprising attaching the weft glass fiber to every warp glass fiber.

12. The method of claim 8, wherein the adhesive is a cyanoacrylate adhesive or an epoxy-based adhesive.

* * * * *